US005540555A

United States Patent [19]

Corso et al.

[11] Patent Number: 5,540,555

[45] Date of Patent: Jul. 30, 1996

[54] REAL TIME REMOTE SENSING PRESSURE CONTROL SYSTEM USING PERIODICALLY SAMPLED REMOTE SENSORS

[75] Inventors: Anthony B. Corso, Cincinnati; G. Mark Elliott, Hudson, both of Ohio

[73] Assignee: Unosource Controls, Inc., Loveland, Ohio

[21] Appl. No.: 318,040

[22] Filed: Oct. 4, 1994

[51] Int. Cl.[6] ..... F04B 49/06

[52] U.S. Cl. ..... 417/44.2; 137/567; 165/219; 165/246

[58] Field of Search ..... 417/18, 44.2, 53; 137/567; 165/22

[56] References Cited

U.S. PATENT DOCUMENTS

| | | | |
|---|---|---|---|
| 3,147,797 | 9/1964 | Miner | 165/22 |
| 3,602,427 | 8/1971 | Joesting | 165/22 |
| 3,875,995 | 4/1975 | Mannion et al. | 165/22 |
| 4,120,033 | 10/1978 | Corso et al. . | |
| 4,487,028 | 12/1984 | Foye | 165/22 |
| 4,502,842 | 3/1985 | Currier et al. | 417/53 |
| 4,549,601 | 10/1985 | Wellman et al. | 165/22 |
| 5,224,648 | 7/1993 | Simon et al. | 165/22 |
| 5,336,054 | 8/1994 | Seah et al. | 417/53 |

FOREIGN PATENT DOCUMENTS

| | | | |
|---|---|---|---|
| 0448345 | 9/1991 | European Pat. Off. | 165/22 |
| 4-6355 | 1/1992 | Japan | 165/22 |
| 6-147688 | 5/1994 | Japan | 165/22 |
| WO89/06774 | 7/1989 | WIPO | 165/22 |

*Primary Examiner*—Richard E. Gluck
*Assistant Examiner*—Xuan M. Thai
*Attorney, Agent, or Firm*—Frost & Jacobs

[57] ABSTRACT

A real time remote sensing pressure control system is provided which uses periodically sampled remote sensors to generate a bias signal that modifies the base setpoint of a proportional-integral controller that controls variable speed pumps. This control scheme saves energy by slowing the rotational speed of the variable-speed secondary pumps during periods of light system demand. The system can be provided with more than one zone of system loads (such as chilled or hot water coils) and a remote pressure sensor (gauge or differential) can be provided at each of those zones. In addition, a local pressure sensor (gauge or differential) is provided at the primary and secondary pumps. The process variable signals detected by the remote pressure sensors is communicated by a building automation system or other type of data highway, which inherently delays the real time nature of those sensed signals and only periodically provides an update of those signals. To provide stable control of the variable speed pumps, the local pump controller utilizes the local pressure sensor's signal to control the speed of those pumps in a stable manner, and a bias signal is provided based upon the periodically updated remote signals from the remote pressure sensors of each zone. In a typical multi-zone control system, the zone requiring the greatest pressure change is selected and its signal is used to create the necessary bias signal that is used to control the variable speed pumps. This control scheme can be utilized in booster pressure systems or other pumping systems in which more than one pumping location must supply water or other liquids to remotely located and diverse loads. In an alternate embodiment, a real time remote sensing pressure control system is provided that utilizes more than one water and pumping source at remote locations from one another to supply a common distribution system. This distribution system can either be a non-recirculating system, such as a potable water system, or can be a recirculating system in which some or all of the liquid is to be returned to the source, such as in chemical plants or oil refineries.

40 Claims, 6 Drawing Sheets

[MASTER]

[SLAVE #2 (TYPICAL)]

REAL TIME REMOTE SENSING PRESSURE CONTROL SYSTEM USING PERIODICALLY SAMPLED REMOTE SENSORS

TECHNICAL FIELD

The present invention relates generally to fluid pressure control systems and is particularly directed to water control systems of the type which maintain a predetermined pressure selected by the user at various points around the water system. The invention is specifically disclosed as a real time remote sensing pressure control system using periodically sampled remote sensors to generate a bias signal that modifies the base setpoint of a proportional-integral controller that controls variable speed pumps. Each local proportional-integral controller is thus able to provide a real-time response for its "local" pumps, while maintaining an additional capacity if required by remote conditions throughout the entire control system.

BACKGROUND OF THE INVENTION

Remote sensing pressure control systems are well known in the art for use in water systems such as chilled water, hot water, and process water systems. A conventional remote sensing differential pressure control system, generally designated by the index numeral 10 is depicted in FIG. 1. In control system 10, a pair of chillers 12 and 14 provide chilled water for a recirculating system. On the inlet side of the chillers are two primary pumps 16 and 18, which have a common "return" pipe 20. On the outlet side of the chillers are two secondary pumps 22 and 24, which typically are variable speed pumps driven by a mechanical variable speed devices or electrical variable speed devices. In such a system, a hydraulic bridge 26 is commonly provided to hydraulically decouple the primary pumps 16 and 18 from the secondary pumps 22 and 24.

On the discharge side of secondary pumps 22 and 24 is a common "supply" pipe 28. The supply piping 28 provides fluid to one or more zones, and in FIG. 1 four zones are depicted, having the index numerals 30, 32, 34 and 36. Each zone includes one or more variable volume loads, such as indicated by index numerals 38 and 40, each of these loads including a flow control valve 42 and a cooling coil 44. The variable volume loads for the other zones are indicated by index numerals 60 and 62 (for zone 32), 64 and 66 (for zone 34), and 68 and 70 (for zone 36). Flow control valve 42 can either be a modulating valve or an on/off valve. It will be understood that cooling coil 44 could be replaced by a heating coil in a control system that replaced chillers 12 and 14 with boilers or some other type of water heating source. Water flow direction is generally designated at various locations by arrows associated with the letter "F".

In the situation in which control system 10 is installed in a high-rise building, a differential pressure sensor 46 will typically be installed in the top floor, and its differential pressure lines 45 and 47 are connected on the supply side of control valve 42 and on the return side of cooling coil 44. It will be understood that the physical location of differential pressure sensor 46 can be located elsewhere within zone 30 while maintaining stable system performance, but by locating sensor 46 on the top floor, the lower floors are guaranteed to be provided with at least as much pressure as the top floor.

Differential pressure sensor 46 has an electrical output which is connected to a pump control panel 50 by use of a dedicated electrical cable 48. In order for pump control panel 50 to properly control the speed of variable speed pumps 22 and 24, the output signal provided by differential pressure sensor 46 must be in real time (i.e., virtually continuous, or at least updated twice per second), or pump control panel 50 will not be able to control these variable speed pumps in a stable manner. This aspect of the conventional control system 10 is so important that a typical installation will include a pair of wires between each of the differential pressure sensors 46, as indicated by index numerals 48, 52, 54, and 56.

In a conventional control system 10 which only includes one zone (i.e., there is only one zone of system loads and only one differential pressure sensor 46), there would only be one pair of wires leading from the differential pressure sensor 46 back to pump control panel 50. In this circumstance, pump control panel 50 can directly control the speed of variable speed pumps 22 and 24 from that single electrical signal that represents the differential pressure sensed by differential pressure sensor 46.

In the circumstance where there are multiple zones (as depicted in FIG. 1 ), pump control panel 50 evaluates the zone having the highest hydraulic demand and selects that zone's differential pressure sensor 46 to control the speed of variable speed pumps 22 and 24. This can functionally be implemented using either pneumatic or electronic controls, and in the case of electronic controls it can be implemented using either analog techniques or using digital techniques.

One unfortunate aspect of control system 10 is that in situations where each of the zones 30, 32, 34, and 36 are remotely located from pump control panel 50, the installed cost for wiring the individual differential pressure sensors 46 to pump control panel 50 can be prohibitive. This aspect not only includes the cost of long runs of wiring conduit for each of electrical cables 48, 52, 54 and 56, but also includes circumstances where it would be almost impossible to install such wiring (e.g., in a campus environment, or where the signal must cross a river).

Remote sensing pressure control systems also are well known in the art for use in non-recirculating booster pump water systems, commonly used in municipal and industrial applications such as public water supply systems and sewage systems as well as for other industrial uses. Such conventional systems generally provide more than one pumping station that feeds pressurized water (or other fluid) to a non-recirculating system, in which the key operating parameter is to always maintain a certain minimum pressure at all points in the system's "grid" of users. Such non-recirculating systems generally do not recirculate the water after it has been used or treated, although certain industrial processes may recirculate portions of their fluids after they have been used.

In many cases of non-recirculating systems, the pumping stations are physically many miles apart from one another, and such conventional systems often use hard-wired remote electrical connections (such as dedicated 4–20 mA loops or dedicated telephone lines with pulse-width tone transmitters and receivers) or radio or other electromagnetic radiation-type links to transfer system operating parameters from station to station, as required to operate the system. Many of these communication links are, unfortunately, very expensive to install and/or operate in real time, and the alternative in such convention systems is to have very slow system response. A method of improving system response time that is also cost-effective would be a significant advance in this field of art.

SUMMARY OF THE INVENTION

Accordingly, it is a primary object of the present invention to provide a real time remote sensing pressure control system that eliminates the dedicated wiring between the pressure sensors and the pump control panel.

It is another object of the present invention to provide a method of controlling a remote sensing pressure control system in real time in circumstances where the typography of the system to be controlled makes it undesirable to install dedicated wiring to perform the communication of the signals between the pressure sensors and the pump control panel.

It is a further object of the present invention to provide a real time remote sensing pressure control system that includes more than one pumping source, but at the same time eliminates the need for real-time signals to be transferred throughout the pump control system.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, a real time remote sensing pressure control system is provided which uses periodically sampled remote sensors to generate a bias signal that modifies the base setpoint of a proportional-integral controller that controls variable speed pumps. This control scheme can be utilized in an HVAC hydronic system that has constant speed primary pumps and variable speed secondary pumps in which energy is saved by slowing the rotational speed of the secondary pumps during periods of light system demand. The system can be provided with more than one zone of system loads (such as chilled or hot water coils) and a remote pressure sensor (gauge or differential) can be provided at each of those zones. In addition, a local pressure sensor (gauge or differential) is provided at the primary and secondary pumps.

The process variable signals detected by the remote pressure sensors is communicated by a building automation system or other type of data highway, which inherently delays the real time nature of those sensed signals and only periodically provides an update of those signals. To provide stable control of the variable speed pumps, the local pump controller utilizes the local pressure sensor's signal to control the speed of those pumps in a stable manner, and a bias signal is provided based upon the periodically updated remote signals from the remote pressure sensors of each zone. In a typical multi-zone control system, the zone requiring the greatest pressure change is selected and its signal is used to create the necessary bias signal that is used to control the variable speed pumps.

In an alternate embodiment, a real time remote sensing pressure control system is provided that uses signals from periodically sampled remote sensors to generate a bias signal that modifies the base setpoint of a proportional-integral controller that controls variable speed pumps. This control scheme can be utilized in booster pressure systems or other pumping systems in which more than one pumping location must supply water or other liquids to remotely located and diverse loads. Such a system can be provided with more than one zone of system loads in which a remote pressure sensor can be provided to each of those zones. In addition, a local pressure sensor is provided at the booster pump. A data highway is used (which can be a radio communication system) to transmit the signals over periodic intervals to provide an update to the local pump controller. To provide stable control of the booster pumps, the local pump controller uses the local pressure sensor's signal to control the speed of those pumps in a stable manner while also using a bias signal that is based upon the periodically updated remote signals received from the remote zones.

In another alternate embodiment, a real time remote sensing pressure control system is provided that utilizes more than one water and pumping source at remote locations from one another to supply a common distribution system. This distribution system can either be a non-recirculating system, such as a potable water system, or can be a recirculating system in which some or all of the liquid is to be returned to the source, such as in chemical plants or oil refineries. The control system measures the pressure at each of the water or liquid sources, and compares it to the desired pressure (i.e., the setpoint) at those locations. Since these locations are remotely located from one another, some type of data highway (i.e. a radio system or hardwired system) is used to transmit data from one of the liquid source locations to the others. Based upon the current conditions in the system, the maximum underpressure deviation is determined for all of the sources of water or liquid, and that deviation is used to determine the value for a bias signal that is provided to all of the pumping stations at each of the sources of water or liquid. This bias signal is typically used to modify the base setpoint of each of the active pumps within the control system, so as to provide stable control of the variable speed pumps by utilizing a combination of the active pump's local pressure sensor's signal, and the periodically updated remote signals (e.g., the bias value) provided over the data highway. Typically, the bias signal is ignored by the pumps that are associated with the portion of the system that is experiencing the maximum underpressure deviation at a particular time.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
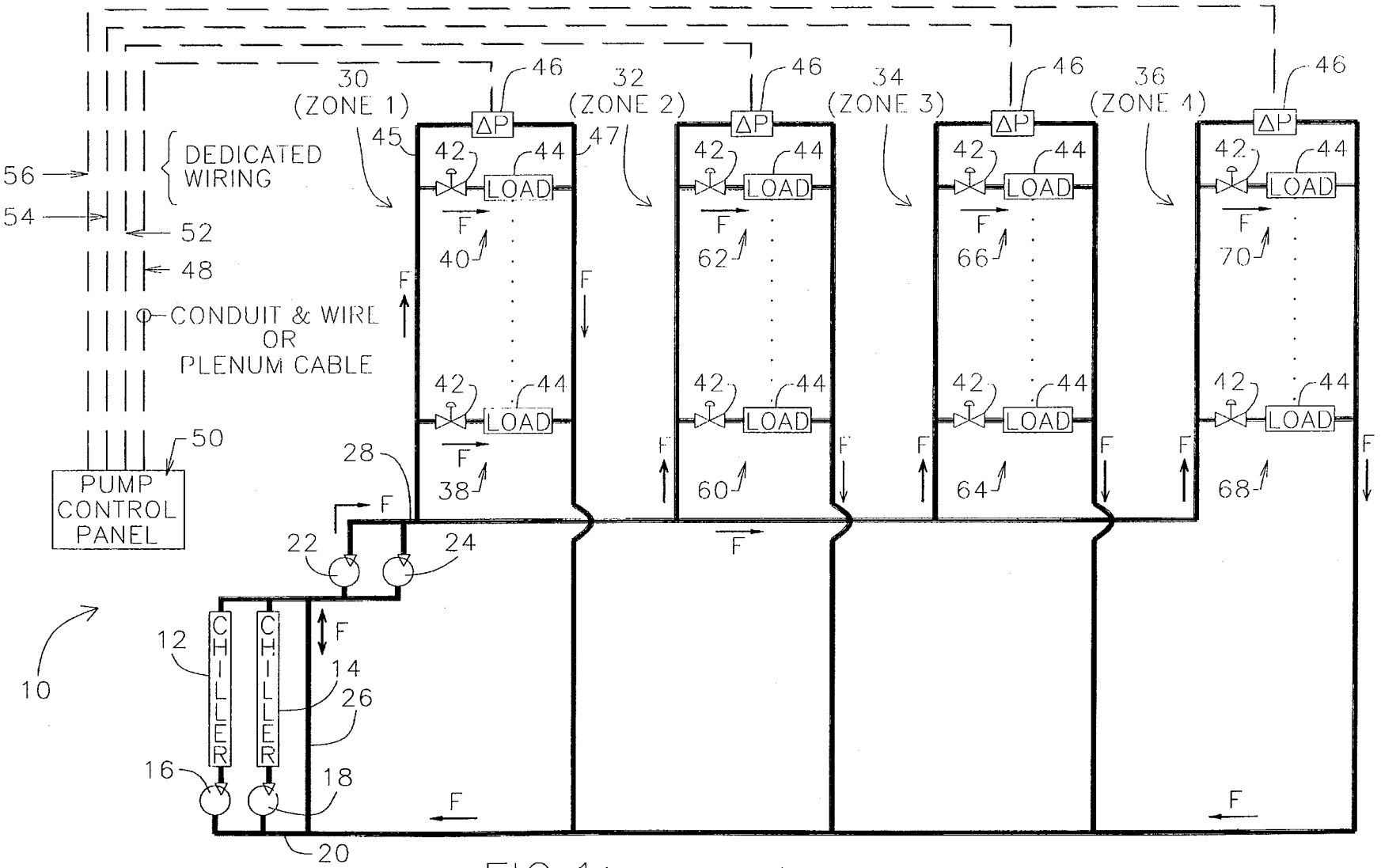
FIG. 1 (PRIOR ART)
FIG. 1 is a schematic and block diagram of a conventional pressure control system having remote sensors that is well known in the prior art.
Figure 2:
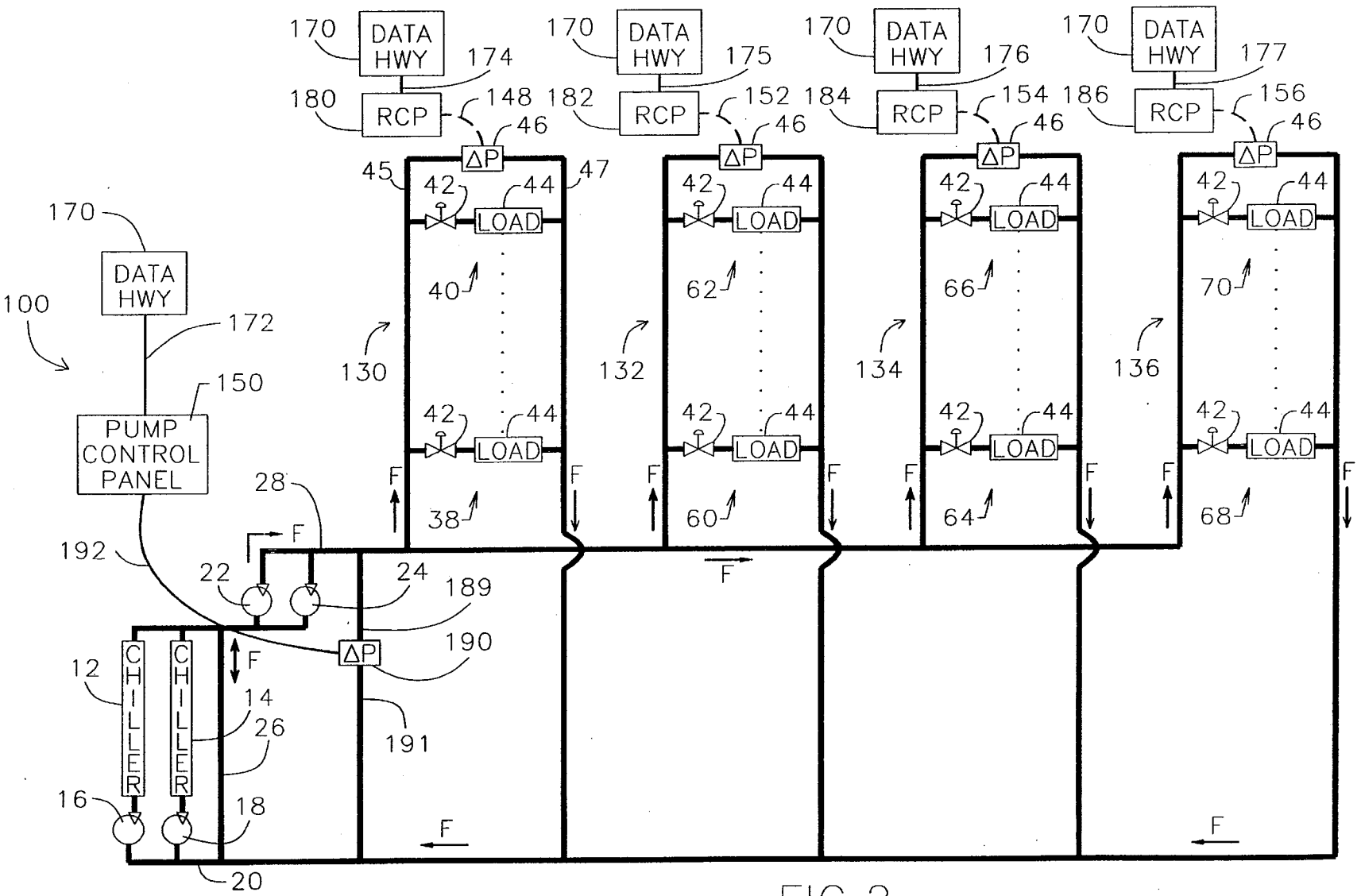
FIG. 2 is a schematic and block diagram of an improved pressure control system having remote sensors as well as a local pressure sensor and a data highway that periodically transfers system operating parameters between the remote control panels and the local pump control panel while controlling the pumps in real time.

Referring now to the drawings, FIG. 2 shows a real time remote sensing differential pressure control system, generally designated by the index numeral 100, which uses periodically sampled remote sensors 46. In control system 100, a pair of chillers 12 and 14, a pair of primary pumps 16 and 18, and a pair of variable speed secondary pumps 22 and 24 are provided along with a hydraulic bridge 26, return pipe 20 and supply pipe 28, in a similar fashion to the prior art system disclosed in FIG. 1. In FIG. 2, four different zones 130, 132, 134 and 136 are depicted, and which make up the system load of control system 100. Each of the zones includes at least one variable volume load 38 or 40, 60 or 62, 64 or 66, and 68 or 70, each of which comprise a flow control valve 42 and a cooling coil 44. In addition, each zone 130, 132, 134 and 136 includes a differential pressure sensor 46 which directly senses the fluid pressure between the inlet to the control valve 42 (via pressure line 45) and to the outlet of the cooling coil 44 (via pressure line 47).

An additional differential pressure sensor, designated by the index numeral 190, is provided having its fluid sensing lines 189 and 191 connected to the return pipe 20 and the supply pipe 28 of control system 100. Differential pressure sensor 190 preferably has an electrical output that is connected to a pump control panel 150 via an electrical cable 192. It will be understood that the output of differential pressure sensor 190 could be a pneumatic or other type of signal rather than an electrical signal.

Each remote differential pressure sensor 46 preferably has an electrical output that is connected to a remote control panel 180, 182, 184 or 186 as depicted in FIG. 2. The output of differential pressure sensor 46 is preferably communicated to its respective remote control panel (e.g., panel 180) via an electrical cable 148, 152, 154, or 156. It will be understood that the output of differential pressure sensors 46 could be a pneumatic or other type of signal rather than an electrical signal. It will be additionally understood that multiple differential pressure sensors (e.g., sensor 46) could be located near and communicated to a single one of the remote control panels (e.g., panel 180).

Remote control panels 180, 182, 184, and 186 are preferably connected together via a data highway 170 which runs throughout various portions of control system 100. It will be understood that data highway 170 can consist of a single global highway, or can consist of several local data highways that meet at nodes which tie them together into a global system. Remote control panel 180 is connected to data highway 170 via an electrical cable 174, remote control panel 182 is connected to data highway 170 via an electrical cable 175, and similarly, remote control panels 184 and 186 are respectively connected to data highway 170 via electrical cables 176 and 177. In addition, the local pump control panel 150 is connected to data highway 170 via an electrical cable 172.

By use of data highway 170, the output signal of each of the remote differential pressure sensors 46 can have its value communicated to pump control panel 150. In a preferred control system 100, data highway 170 communicates by use of digital signals which are either multiplexed or multidropped, and the analog values of the output signals of each of the remote differential pressure sensors 46 are converted into digital numbers for transmission over data highway 170. Once they are received at pump control panel 150 (via electrical cable 172), these various digital representations of the differential pressure sensor signals are used in pump control panel 150 to control the output speed of variable speed pumps 22 and 24. In a preferred control system 100, each remote control panel 180, 182, 184, and 186 comprises a data gathering and/or control panel which are members of a building automation system. Such data gathering and/or control panels may be only data gathering units which simply receive and transmit signals to and from their particular locations over data highway 170, or these panels may actually control certain facility equipment located nearby, such as the air handler that is associated with a particular flow control valve 42 and cooling coil 44.

At the local pump control panel 150, data highway 170 may communicate to a separate data gathering and/or control panel (not shown) via electrical cable 172. In this circumstance, the data gathering and/or control panel would preferably include electrical outputs that will communicate either analog or digital signals that are representative of the differential pressures sensed by the remote differential pressure sensors 46. These digital or analog signals would then be received by pump control panel 150 which uses that information to control the speed of the variable speed secondary pumps 22 and 24.

Figure 3:
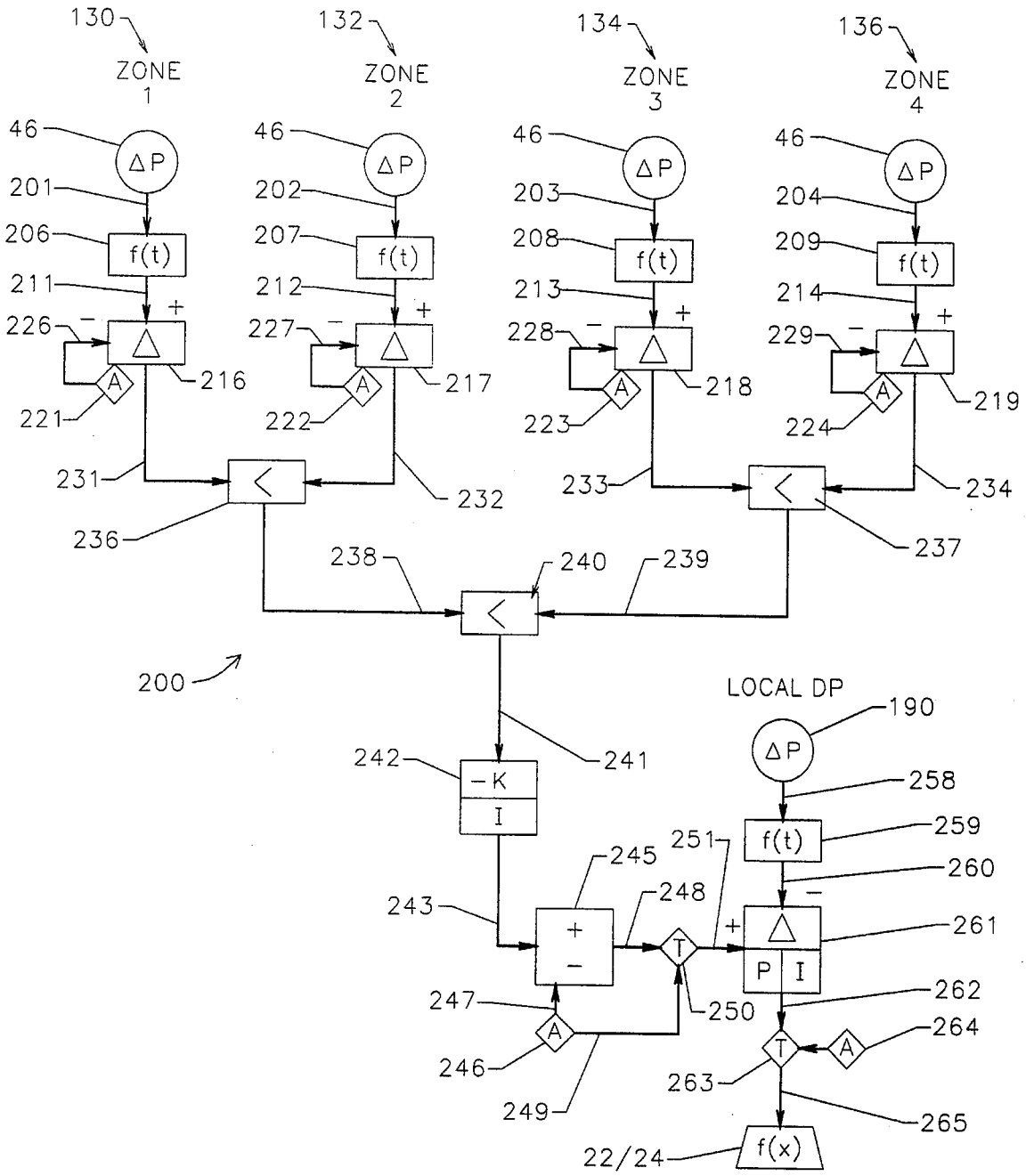
FIG. 3 is a SAMA flow chart that describes the control logic of the local pump control panel depicted in FIG. 2.

FIG. 3 shows a SAMA flow chart 200 which discloses the details of the methodology of control system 100. Each remote differential pressure sensor 46 outputs a signal representative of its presently sensed differential pressure, and in FIG. 3 these output signals are schematically represented by arrows 201,202,203, and 204 for system zones 1 through 4, respectively. Signals 201–204 preferably are operated on by low pass filters 206–209, respectively, which filter out extraneous noise in system 100. On the output side of low pass filters 206–209, the filtered differential pressure signals follow arrows 211–214, respectively, and into signal processing blocks 216–219, respectively.

The signal processing blocks 216–219 have associated variable signal generators 221–224, respectively, which act as setpoints in control system 100. The setpoints 221–224 are used to choose the desired system pressure for each of zones 1–4. The outputs of signal generators 221–224 are directed along arrows 226–229, respectively, into the negative inputs of difference function blocks 216–219, respectively. Within difference function blocks 216–219, the setpoint signals 226–229 are subtracted from the actual differential pressure signals 211–214, respectively, providing "deviation" signals 231–234, respectively. It will be understood that deviation signals 231–234 have values that can be bipolar depending on whether or not the actual system pressure is greater than the desired setpoint.

In control system 100, it is preferred that there is only one single output signal that controls the speed of variable speed pumps 22 and 24. Due to the multiplicity of input signals provided by zones 1–4, it is preferred that a method of selecting the zone that has the greatest underpressure deviation signal 231–234 be identified and selected to modify the base control within flow chart 200. Consequently, a low signal selector function block 236 is provided to select the signal having the lower value from between signals 231 and 232, and thereby outputting a selected signal 238.

If, for example, the actual pressure of zone 1 sensed by differential pressure sensor 46 is 50 feet of water, and the setpoint output by signal generator 221 is 65 feet of water, then the value of signal 231 output from the difference function block 216 will be −15 feet of water. If the actual pressure sensed in zone 2 by differential pressure sensor 46 is 44 feet of water, and its signal generator 222 has a setpoint of 70 feet of water, then its deviation signal 232 output from difference function block 217 will be −26 feet of water. In this example, low signal selector 236 will choose signal 232 since −26 is less than −15, and the deviation signal 238 will have a value of −26 feet of water.

In a similar manner, low signal select function block 237 selects the lower of the deviation signals 233 and 234, thereby outputting a selected deviation signal 239. Low deviation signals 238 and 239 are compared once again by a further low signal select function block 240, which has an output signal 241 that represents the lowest signal of all four zones 1 through 4 (zones 130, 132, 134, and 136).

The selected signal 241 is communicated as an input to an "integrator" signal processing block 242, which inverts and integrates the input signal 241 and outputs a signal 243. This integrated output signal 243 is communicated as an input to a bias signal function block 245 that also accepts an input signal 247 which is the output of signal generator 246 which provides the base control setpoint. The output of the integrator of function block 242 can change over time even though its input signal 241 from the low signal selector has not changed in value. The output of bias signal function block 245, designated arrow 248, is input into a signal transfer device or switch 250 which determines whether or not the bias signal function block 245 is to be utilized in control system 100. If the bias control is not to be used, then the signal generator 246 (the base control setpoint) is output along arrow 249 into signal transfer device 250. The selection of signal transfer device 250 is an operator initiated event from a hardware/software switch that is well known in the art. It will be understood that control system 100 can be constructed using a microprocessor or other type of processing device, discrete logic, or analog electronic techniques.

The output of signal transfer device 250 is preferably connected to the positive input of a differential pressure controller designated index numeral 261, at location 251. Local differential pressure sensor 190 provides a signal that travels along arrow 258 into a low pass filter 259, and continues along arrow 260 into the negative input of differential pressure controller 261. Based upon the actual system pressure (provided by local differential pressure sensor 190) as compared to the setpoint determined by signal generator 246 and the bias provided by signal 241, the differential pressure controller 261 will provide a variable output command at location 262 on flow chart 200. This output command enters a second signal transfer device or switch 263, which also accepts as an input a manual "speed" signal from another signal generator 264, and one or the other of the signals is output from signal transfer device 263 along arrow 265 to the variable speed secondary pumps 22 and 24.

As an example of the operation of control system 100 and flow chart 200, the unbiased based setpoint provided by signal generator 246 is set to 50 feet of water, and the present differential pressure sensed by local differential pressure sensor 190 is equal to 55 feet of water. Referring to the example given above, the current maximum deviation from the four zones at signal 241 is presently −26 feet of water. This −26 value enters signal processing block 242 which first inverts the signal causing it to become +26 feet of water, and then integrates the signal over time to provide a correcting bias signal at arrow 243. In this example, the output of signal processing block 242 is currently at +10 feet of water as it enters the bias signal processing block 245. Because of the output value of +50 from signal generator 246, the overall base setpoint of control system 100 is equal to 50 feet of water plus the bias signal value of +10 feet of water, giving a total of +60 feet of water. Since the overall base setpoint is 60 feet of water, but the local process variable value is only at 55 feet of water, (as sensed by local differential pressure sensor 190), the output value of differential pressure controller 261 must increase to drive the variable speed secondary pumps 22 and 24 at a faster speed.

Differential pressure controller 261 will immediately act on this information and increase its output 265 which controls variable speed pumps 22 and 24. As the output speed of these pumps increases, so will the discharge pressure of those pumps which is immediately detected by local differential pressure sensor 190. Since local differential pressure sensor 190 is hard wired by electrical cable 192 into pump control panel 150, the signal 260 is immediately fed into differential pressure controller 261, thereby allowing it to properly control its rate of change of its output signal 265 such that the rate of change will decrease as the system process variable sensed by local differential pressure sensor 190 approaches the actual setpoint (which is presently at 60 feet of water). Once the process variable sensed by differential pressure sensor 190 is equal to the biased setpoint of 60 feet of water, then the output signal 265 of differential pressure controller 261 will remain at its last value.

The signals provided by the remote control panels 180, 182, 184, and 186 are not transferred to the pump control panel 150 in real time. In a situation where a data highway 170 is provided by a typical building automation system, the updated value of a particular remote differential pressure sensor 46 in one of the zones potentially will not be updated for several minutes, sometimes as many as 15 minutes. Under this circumstance, stable pump control of the variable speed secondary pumps 22 and 24 that is reasonably responsive to system load variations would be virtually impossible based solely on these periodically updated signals from remote differential pressure sensors 46. Control system 100 achieves stable and responsive operation by controlling from the local differential pressure sensor 190, rather than attempting to control from one or more of the remote differential pressure sensors 46.

The purpose of the bias signal processing block 245 is to make differential pressure controller 261 aware that the system demand in one or more of the remote zones is not being satisfied, and to provide a mechanism for satisfying the demand as it varies, and as it is being updated by the periodically sampled signals output along data highway 170. As a further example of this effect, assuming the system pressure at the local differential pressure sensor 190 (arrow 260) has achieved 60 feet of water, and the current biased setpoint (arrow 248) is also at 60 feet of water, zone 2 (zone 132) has increased its system pressure to the point where it has increased to above its current setpoint of 70 feet of water (as sensed by its differential pressure sensor 46) and is now at 80 feet of water.

Assuming the other three zones have correspondingly also increased at their local pressures to the point where zone 2 still exhibits the lowest deviation, then its deviation signal 232 will now be at +10 feet of water, and since it still is the minimum deviation in the system, signal 241 will also have a value of +10 feet of water. As this value enters signal processing block 242, it is first inverted into a –10 feet of water signal, then integrated, and the output, for example, analog signal 243 will become –4 feet of water. The bias signal processing block 245 will accept this –4 feet of water and sum it with the value of +50 feet of water provided by signal generator 246, thereby outputting a base setpoint of +44 feet of water at location 251 as an input to the differential pressure controller 261. Since the local system pressure at local differential pressure sensor 190 is at 60 feet of water, and the new base setpoint is only at 44 feet of water, differential pressure controller 261 will now attempt to slow down variable speed secondary pumps 22 and 24, accordingly.

It will be understood that all of the functions described in flow chart 200 are preferably implemented by an electronic device such as a microprocessor-based controller located within pump control panel 150. It is preferred that the remote differential pressure sensors 46 be configured as pressure transmitters having a 4– 20 mA output, with a sufficient pressure sensing range to accommodate the typical system pressures that exist at cooling coils, e.g., zero to 100 feet of water. The local differential pressure sensor 190 is preferably also configured as a pressure transmitter having a 4–20 mA output, and its sensing range would be for a much higher pressure, such as zero to 200 feet of water.

It will be further understood that other control schemes than disclosed in flow chart 200 can be used without departing from the principles of the present invention. For example, each of the zones 1 through 4 (designated by index numerals 130, 132, 134, and 136, respectively) can include their own differential pressure controller (such as differential pressure controller 261), and can calculate the desired increase or decrease in their output signals. In such a circumstance, one of the four zones would control the overall system's output to the secondary pumps 22 and 24 by use of a high signal selector scheme, in which the zone requiring the greatest change in output would be chosen as the controlling zone. Based upon that zone's required output change, that would be sent through an integrator (such as the integrator of signal processing block 242) before being passed into a bias signal processing block (such as block 245) and then either added or subtracted from the output signal that is determined by the differential pressure controller 261. The final biased output signal would then be sent to the variable speed secondary pumps 22 and 24.

Additional control schemes may involve the detecting of the zone having the highest load (rather than the zone having the greatest deviation), or the zone requiring the greatest correction to bring its actual differential pressure to its setpoint. For example, if the setpoints of the various zones are not equal, then a given deviation between actual pressure and setpoint for each zone would represent a certain percentage of correction needed to bring each of the zones to its setpoint. Assuming in this example that the deviation of each of the four zones 130, 132, 134, and 136 is presently –5 feet of water, but the setpoints for these zones are, respectively, 55 feet, 50 feet, 53 feet, and 60 feet of water. It is apparent that zone 132 (Zone 2) requires the greatest correction of the four zones because a –5 feet deviation represents a ten percent (10%) correction as compared to its setpoint of 50 feet and the other zones each requires something less than a ten percent (10%) correction. Therefore, in this scheme, zone 132 (Zone 2) presently would be the controlling zone in the system, and secondary pumps 22 and 24 would be controlled accordingly, after an appropriate bias (at the base controller 261 ) is included.

In another example, the zone having the highest load could be used as the controlling zone in a system in which the setpoints for all zones were always equal to one another. In such a control system, the controlling zone would be determined by detecting the differential pressure of each zone 130, 132, 134, and 136 and selecting the zone that presently was maintaining the lowest actual differential pressure (as measured by remote differential pressure sensors 46). This type of control system somewhat simplifies the steps taken to control the secondary pumps 22 and 24, however, most of the logic depicted in flow chart 200 would still be required, including the bias signal at the base controller 261.

Figure 4:
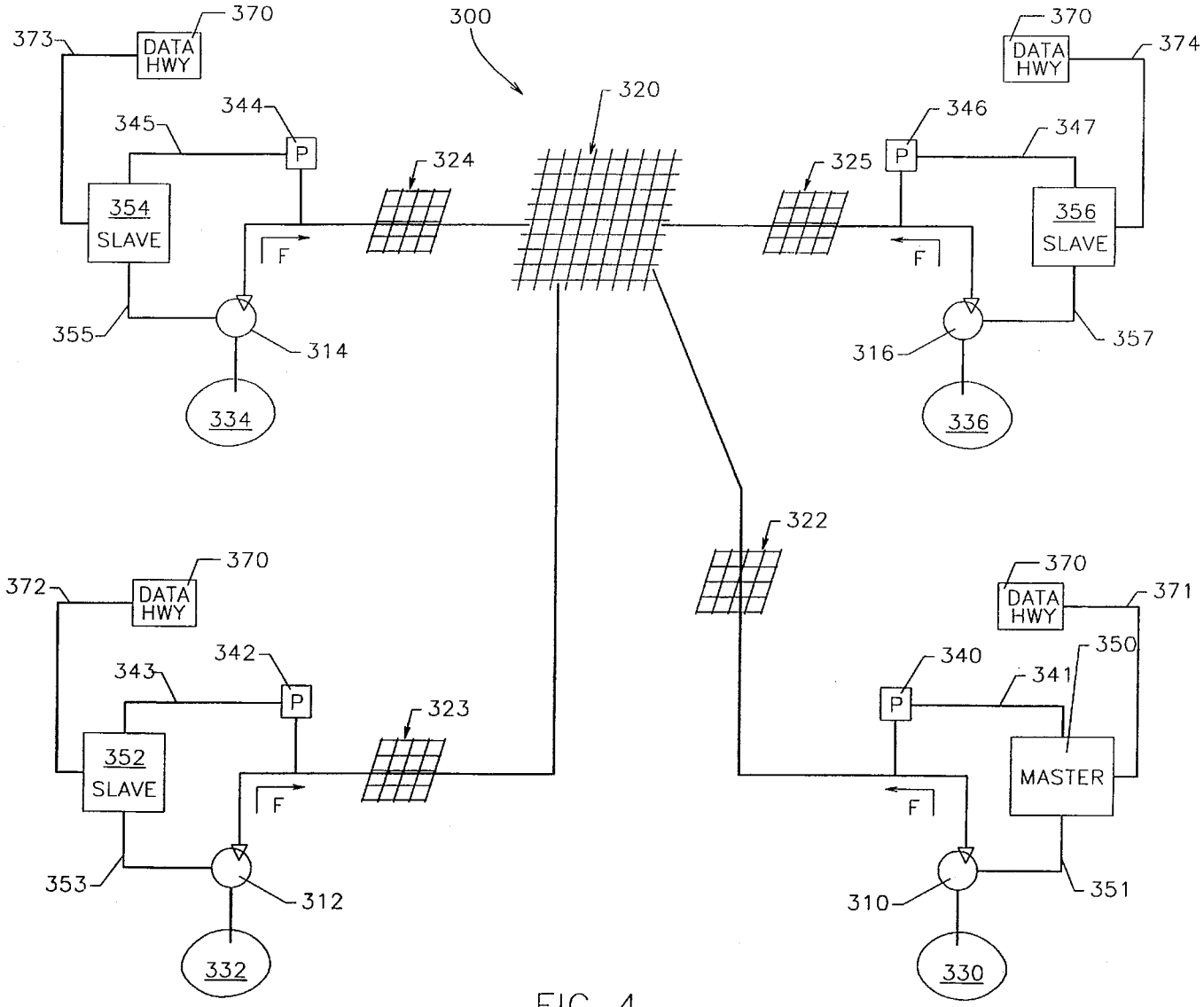
FIG. 4 is a schematic and block diagram of an improved non-recirculating pressure control system having more than one pumping station in which each pumping station has a "local" pressure sensor and a data highway that periodically transfers system operating parameters between the various "master" and "slave" control panels, while each of the control panels controls its "local" pumps in real time.

In an alternate embodiment of the present invention, a non-recirculating system can be controlled having system loads at more than one location and having system pumps at more than one location. An example of such a system is depicted in FIG. 4, which shows a system schematic diagram generally designated by the index numeral 300. System 300 includes several booster or high service pumps, designated by the index numerals 310, 312,314, and 316. These pumps are preferably variable-speed pumps, and each has a discharge output that feeds into some type of distribution system, generally designated by the index numeral 320. Various other system loads may also exist in system 300, such as the general distribution loads 322, 323, 324, and 325, as shown in FIG. 4.

Each of pumps 310, 312, 314 and 316 draws water from an individual water source, such as a pipeline, lake, or reservoir, as depicted by the index numerals 330, 332, 334, and 336. The discharge of each of these pumps is preferably connected to a gauge pressure sensor, such as pressure sensors 340, 342, 344, and 346. Each of these pressure sensors has an output that is communicated to some type of control panel via lines 341, 343, 345, and 347, respectively. It will be understood that non-recirculating system 300 could be used to pump any liquid, and is not restricted to water applications.

As can be seen in FIG. 4, system 300 does not have a "return" line that feeds back to any of the water sources 330, 332, 334, or 336. The direction of flow at all locations is away from the discharge of the active pumps, as indicated by the arrow "F" into the distribution system 320, although any one pump (i.e., pump 314) is capable of providing pressurized water to any location within system 300, including at remotely-located pressure sensors (e.g., pressure sensors 340, 342, and 346). It will be understood that this same system configuration depicted in FIG. 4 could be used with a return line to make system 300 into a recirculating system, if desired. One application where a recirculating system may be desirable would be for a large chemical processing plant or an oil refinery, where there are several independent liquid sources that feed into a distribution system, in which some or all of the liquid is to be returned back to the liquid sources.

In system 300, it is preferred that each of the sources of liquid (reservoirs or lakes 330, 332, 334, and 336) also have some type of control panel to direct the operation of the associated pump or pumps. In the illustrated embodiment of FIG. 4, water source 330 has an associated control panel designated by the index numeral 350, which receives the signal line from the output of pressure sensor 340 (via line 341), and has an output control line 351 that is connected to pump 310. In a similar manner, reservoir 332 has a control panel 352 which is connected to the output line 343 from pressure sensor 342, and has an output control line designated by the index numeral 353 that is connected to pump 312. Reservoir 334 has a control panel 354 that receives an output line 345 from pressure sensor 344, and has an output control line 355 that is connected to pump 314. Water source 336 has a control panel 356 that receives an output line 347 from pressure sensor 346, and has an output control line 357 that is connected to pump 316.

In system 300, one of the control panels is preferably designated the "master," and the other control panels are designated "slaves." Control panel 350 is chosen as the "master" panel in the illustrated embodiment of FIG. 4, and panels 352, 354, and 356 are all designated as slaves. Each of these control panels communicates to other control panels via a data highway, generally designated by the index numeral 370, via communication cables 371, 372, 373, and 374. It will be understood that data highway 370 can be a hard-wired highway, consisting of electrical cable or fiber optic cable, or can be some other type of communication link such as a radio transmitting/receiving system. The farther apart the physical locations of the water sources 330, 332, 334, and 336, the more likely that the data highway 370 will comprise some type of electromagnetic radiation link rather than the use of physical cables.

In system 300, it is preferred that the master control panel 350 receive the pertinent operating information from each of the slave control panels 352, 354, and 356 via data highway 370. After the master panel 350 has all this information, it is then in a position to decide whether or not any "bias" should be added to the setpoints of any of these slave or master control panels.

Figure 5:
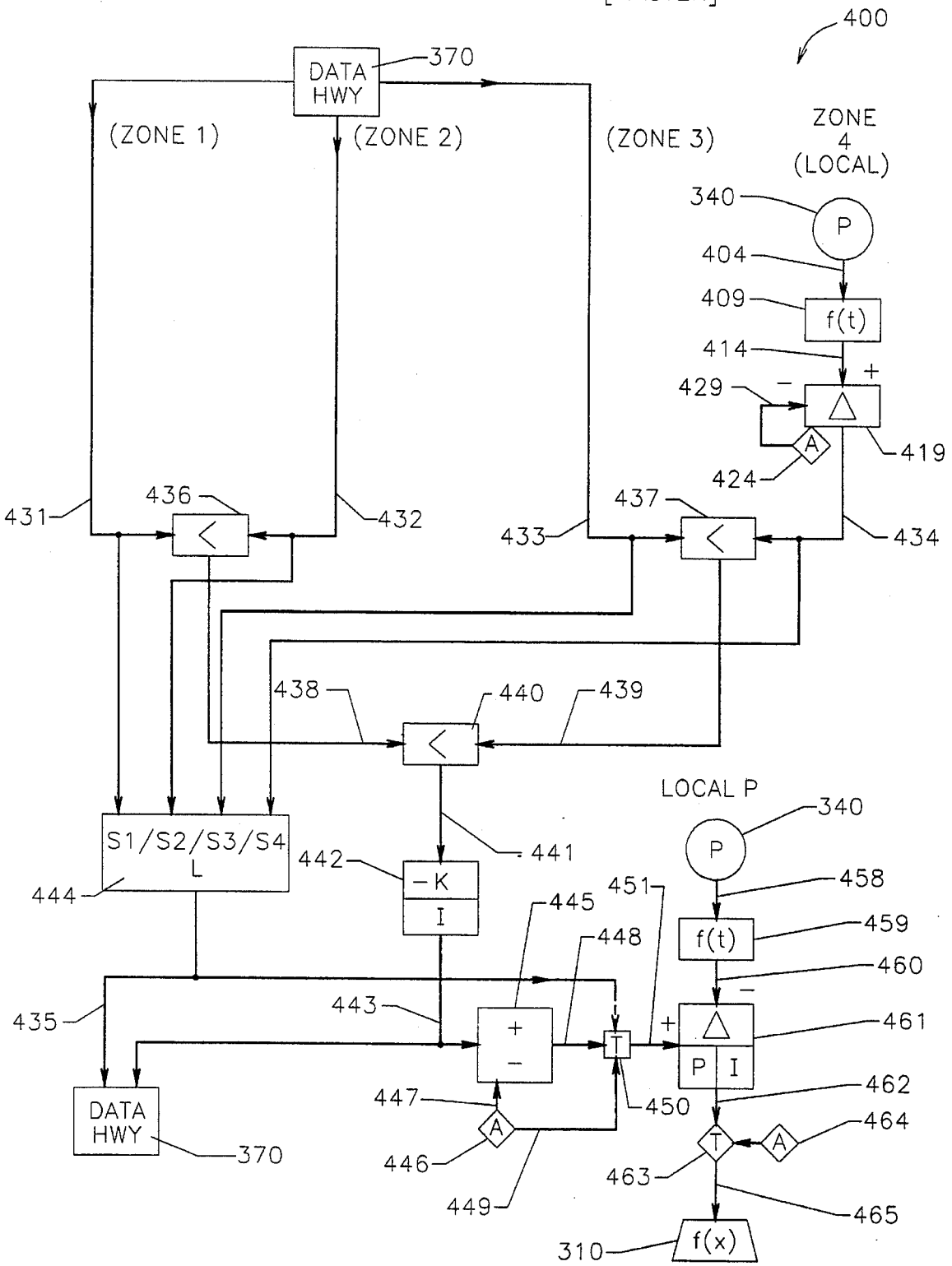
FIG. 5 is a SAMA flow chart that describes the control logic of the "master" pump control panel depicted in FIG. 4.

A SAMA flow chart 400 is provided in FIG. 5 that describes the details of the methodology of the control scheme for the master control panel 350. Data highway 370 transmits and receives the appropriate signals, such as some of the slave operating parameters including the present system pressure at the pressure sensor for each slave, the present setpoint the slave control panel is set at, the present deviation for that slave control panel, pump status, the slave pump start/stop command, alarm signals relating to the slave control system, and other various operating parameters. Master control panel 350 utilizes the deviation signals provided by each of the slave control panels, which are designated by the index numerals 431, 432, and 433, respectively, representing the deviation signals from slave control panels 352, 354, and 356. Once these deviation signals arrive to master control panel 350, they are compared to one another and to the master control panel's own deviation signal, designated by the index numeral 434, by use of low signal selector function blocks 436, 437, and 440 to select the signal which has the lowest value from the group of signals 431–434. Once this has occurred, the lowest signal value will be output from low signal selector function block 440 along a signal line having the index numeral 441.

The selected signal 441 is communicated as an input to an "integrator" signal processing block 442, which inverts and integrates the input signal 441 and outputs a signal 443. This integrated output signal 443 is communicated as an input to a bias signal function block 445 that also accepts an input signal 447 which is the output of signal generator 446 which provides the base control setpoint. The output of the integrator of function block 442 can change over time even though its input signal 441 from the low signal selector has not changed in value. The output of bias signal function block 445, designated arrow 448, is input into a signal transfer device or switch 450 which determines whether or not the bias signal function block 445 is to be utilized in control system 300.

The output of signal transfer device 450 is preferably connected to the positive input of a pressure controller designated index numeral 461, at location 451. Pressure sensor 340 provides a signal that travels along arrow 458 into a low pass filter 459, and continues along arrow 460 into the negative input of pressure controller 461. Based upon the actual system pressure (provided by pressure sensor 340) as compared to the setpoint determined by signal generator 446 and the bias provided by signal 441, the pressure controller 461 will provide a variable output command at location 462 on flow chart 400. This output command enters a second signal transfer device or switch 463, which also accepts as an input a manual "speed" signal from another signal generator 464, and one or the other of the signals is output from signal transfer device 463 along arrow 465 to the variable speed pump 310.

The bias signal 443 that is calculated by master control panel 350 is output to data highway 370 so that it's value can be communicated to each of the slave control panels 352, 354, and 356. In this manner, the overall system bias requirements are known to all of the independent pumps and water sources, which are typically separated by a great distance and, therefore, remotely located from one another. Each of these slave control panels will then determine exactly how the bias signal information is to be used depending upon the current control operating circumstances within control system 300. This is also true for master control panel 350, in which it's pressure controller 461 may or may not itself use the bias signal, depending upon the circumstances. These circumstances affect the operation of signal transfer device or switch 450, and if the bias signal is not to be used, the base control setpoint is provided by signal generator 446 and is output via arrow 449 through signal transfer device 450 into the pressure controller 461. If the bias is to be used, the base control setpoint 446 is output via arrow 447 into a bias signal function block 445, which also accepts the bias signal 443 and outputs a combined signal along arrow 448 into signal transfer device 450, for further transmission into pressure controller 461, via arrow 451. It will be understood that control system 300 can be constructed using a microprocessor or other type of processing device, discrete logic, or analog electronic techniques.

Master control panel 350 must determine which "zone" of water control system 300 is the one that has the maximum deviation requirements at any particular moment. While the actual analog value of this deviation is calculated by the low signal selector function blocks 436, 440, and 437, that numeric value does not indicate which physical zone is the one that requires the most correction at a particular moment. Therefore, deviation signals 431–434 are each input into a comparator function block, designated by the index numeral 444, which outputs an indication as to which of the zones is currently being selected, and this indication is designated by the index numeral 435. The selected zone indication signal 435 is output to the data highway 370, and is also input as the automatic control parameter for signal transfer switch 450. It is preferred that the bias signal 443 not be added to setpoint 446 if the selected zone signal 435 indicates that the system zone containing master control panel 350 is the one presently incurring the maximum deviation condition within water control system 300.

Figure 6:
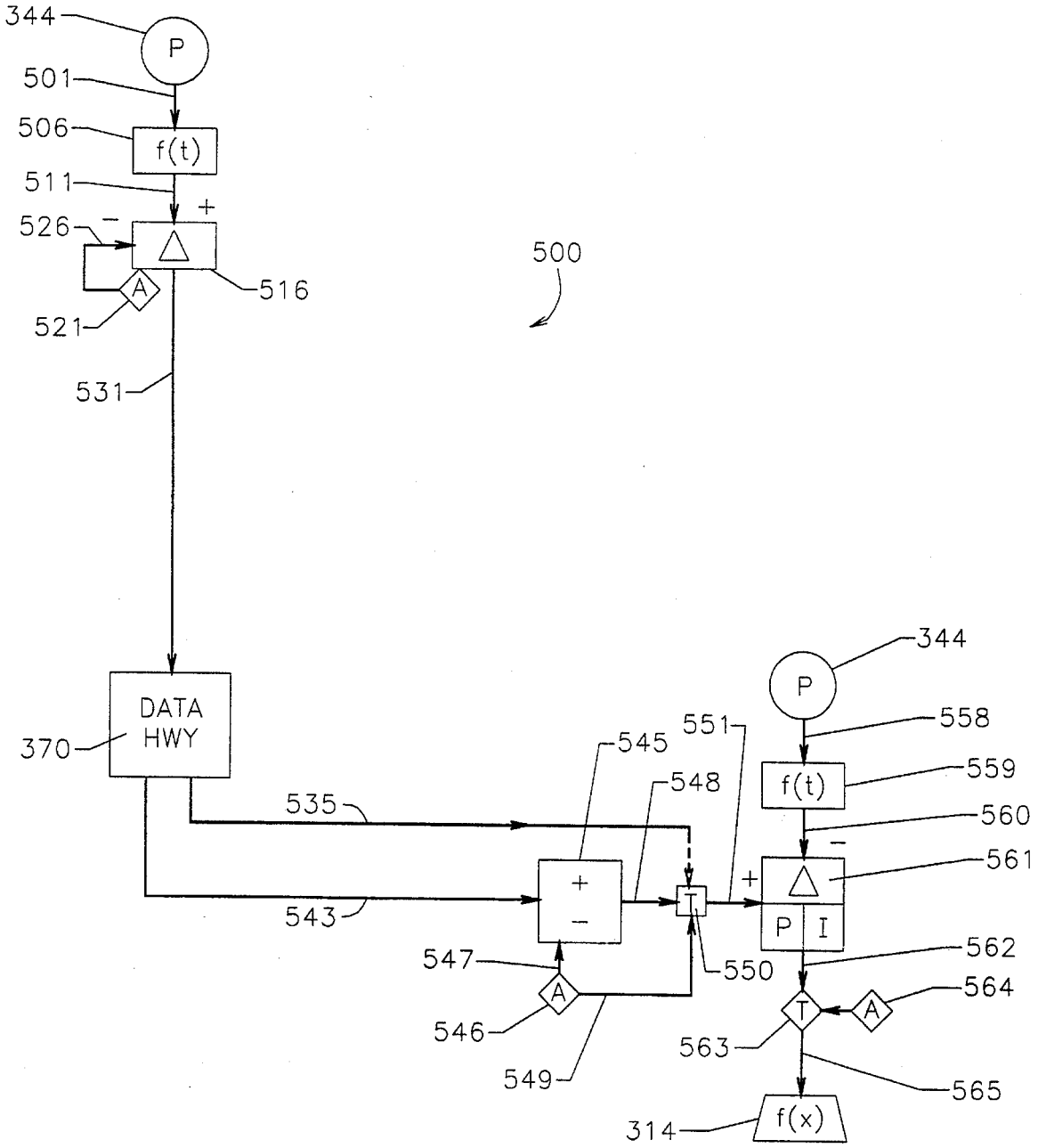
FIG. 6 is a SAMA flow chart that describes the control logic of the "slave" pump control panel depicted in FIG. 4.

A SAMA flow chart 500 is provided in FIG. 6 describing the details of the methodology of a typical slave control panel (e.g., panels 352, 354, and 356). In the illustrated embodiment of FIG. 6, flow chart 500 depicts the control scheme for slave control panel 354, which is associated with pressure sensor 344. Pressure sensor 344 outputs a signal representative of its presently sensed pressure, and in FIG. 6 this output signal is schematically represented by arrow 501. Signal 501 preferably is operated on by a low pass filter 506 which filters out extraneous noise in system 300. On the output side of low pass filter 506, the filtered pressure signal follows arrow 511, and into signal processing block 516.

Signal processing block 516 has an associated variable signal generator 521 which acts as a setpoint in control system 300. Setpoint 521 is used to choose the desired system pressure for slave control panel 354. The output of signal generator 521 is directed along arrow 526 into the negative input of difference function block 516. Within difference function block 516, the setpoint signal 526 is subtracted from the actual pressure signal 511, providing a "deviation" signal 531. It will be understood that deviation signal 531 has values that can be bipolar depending on whether or not the actual system pressure is greater than the desired setpoint. Once the deviation has signal 531 has been calculated, it is then communicated to data highway 370 for transmission back to master control panel 350.

Data highway 370 also communicates an input signal to slave control panel 354, which is the system bias value that the master control panel 350 has calculated for use by all of the control panels of water system 300. This bias signal is designated by the arrow 543 and is input into a bias signal function block 545 that also accepts an input signal 547 which is the output of signal generator 546 which provides the base control setpoint. The output of bias signal function block 545, designated arrow 548, is input into a signal transfer device or switch 550 which determines whether or not the bias signal function block 545 is to be utilized in control system 300.

The bias signal 543 that is calculated by master control panel 350 is output to data highway 370 so that it's value can be communicated to each of the slave control panels 352, 354, and 356. In this manner, the overall system bias requirements are known to all of the independent pumps and water sources, which are typically separated by a great distance and, therefore, remotely located from one another. Each of these slave control panels will then determine exactly how the bias signal information is to be used depending upon the current control operating circumstances within control system 300, including slave control panel 354, in which it's pressure controller 561 may or may not itself use the bias signal, depending upon the circumstances. These circumstances affect the operation of signal transfer device or switch 550, and if the bias signal is not to be used, the base control setpoint is provided by signal generator 546 and is output via arrow 549 through signal transfer device 550 into the pressure controller 561. If the bias is to be used, the base control setpoint 546 is output via arrow 547 into a bias signal function block 545, which also accepts the bias signal 543 and outputs a combined signal along arrow 548 into signal transfer device 550, for further transmission into pressure controller 561, via arrow 551.

The output of signal transfer device 550 is preferably connected to the positive input of a pressure controller designated index numeral 561, at location 551. Pressure sensor 344 provides a signal that travels along arrow 558 into a low pass filter 559, and continues along arrow 560 into the negative input of pressure controller 561. Based upon the actual system pressure (provided by pressure sensor 344) as compared to the setpoint determined by signal generator 546 and the bias provided by signal 541, the pressure controller 561 will provide a variable output command at location 562 on flow chart 500. This output command enters a second signal transfer device or switch 563, which also accepts as an input a manual "speed" signal from another signal generator 564, and one or the other of the signals is output from signal transfer device 563 along arrow 565 to the variable speed pump 314.

Data highway 370 also provides a second input signal to slave control panel 354 which is designated by the index numeral 535 which indicates which of the zones of water control system 300 is currently the zone experiencing the maximum deviation. If the control panel 354 is currently associated with the zone experiencing the maximum deviation, then signal 535 will indicate to the control transfer device 550 that it should not allow the bias signal 543 to be added to the setpoint 546.

It is preferred that the water system 300 illustrated in FIG. 4 should determine which one of the pumps 310, 312, 314 and 316 should be the "lead" pump and which should be the "lag" pumps. In a typical water distribution system, there will always be at least one pump running, which is designated the lead pump. To more uniformly spread the wear due to pump operation, it is standard industry practice to periodically change which one of the pumps is the lead pump, and by doing so, no one of these pumps should wear out prematurely. It will be understood that the pump 310 located at master control panel 350 will not always be the lead pump. In fact, in water control system 300, pump 310 should only be the lead pump approximately one-fourth of the time. This, of course, assumes that each of pumps 310, 312, 314, and 316 have approximately equal pumping capacities, and would take into account that other operating parameters, such as the elevation of each of these pumps, can change certain of these parameters.

Assuming only one pump (the lead pump) is running at a particular moment, it is desired that the system pressure requirements at each of the sensors 340, 342, 344, and 346 be satisfied at all times. Assuming pump 310 is the lead pump for the moment, its control panel 350 can respond in real time to the signals output by pressure sensor 340, because they are hard wired to one another through some type of cable (i.e., cable 341). However, pump control panel 350 cannot immediately respond to low pressure situations occurring at the remote locations, as sensed by pressure sensors 342, 344, and 346. It is, therefore, desirable that the operating parameters of each of these slave control panels 352, 354 and 356 be periodically transmitted via data highway 370 to master control panel 350, so that the underpressure deviation, if any, at each of those remote sensors can become known so master control panel 350 can take corrective action (e.g., by commanding pump 310 to increase speed to raise the system pressure). As described above, the selected deviation signal 441 will be used to generate a bias signal 443, and in this circumstance, that bias signal will be used to modify the base setpoint 446 within master control panel 350. If bias signal 443 currently has a positive value, then the output signal 465 to pump 310 will be changed to command that pump to run at a faster speed (to increase the system pressure).

If pump 310 is no longer the lead pump, then control system 300 operates in a similar manner, however, it will be one of the slave control panel associated pumps that will be running as the lead pump. For example, if pump 314 is running at slave control panel 354, and no other pumps are running, then its pressure sensor 344 will be measuring its own local system pressure and comparing it to its own internal setpoint, which is represented by signal generator 546 on FIG. 6. Master control panel 350 periodically receives the deviation signals from each of the slave control panels 352, 354, and 356, as described above, and master control panel 350 then determines whether or not a system bias is necessary at the current time. Assuming that a system bias is desired (i.e., one of the pressure sensors 340, 342, or 346, is indicating a pressure that is below its local setpoint), then there will be a positive deviation signal at one of those points within control system 300. Once the lowest deviation signal is selected by master control panel 350, that will become the signal used to create the bias signal 443.

During the communications update of control panel 354, bias signal 443 will be communicated via data highway 370 and will be input as signal 543 (as viewed on FIG. 6). This bias signal will be used by the control scheme depicted by flow chart 500 to modify the setpoint provided by signal generator 546, via summing function block 545, unless signal transfer device 550 does not allow this bias signal 548 to travel through and into pressure controller 561. Signal transfer device 550 is automatically controlled by the low selected zone signal 535, which is a data value that is input from data highway 370 (and has been previously determined by master control panel 350). If the zone that has the most deviation also happens to be the zone associated with slave control panel 354, then the bias signal 543 will be ignored because the pressure controller 561 will already be aware (in real time) that it has not satisfied its system's pressure demand as sensed by pressure sensor 344. The setpoint determined by signal generator 546 will not have been satisfied, and any extra bias value provided by signal 543 would not be useful information in this instance, since this particular zone (at water source 334) already requires the most correction within water control system 300. On the other hand, if low selected zone signal 535 indicates that one of the other zones in the system is the zone having the greatest deviation then signal transfer device 550 will allow bias signal 543 to be added to the local setpoint 546 at summing function block 545 before entering pressure controller 561.

If the lead pump of water control system 300 is located at one of the slave control panels 352, 354 or 356, then that pump will always be running because water distribution system 320 will always have a certain minimal demand. If none of the lag pumps are currently running, then only the lead pump will be running. For example, if pump 314 is the lead pump at a particular time, then it will be running and hopefully satisfying the system pressure demands as sensed by all of the remote pressure sensors 340, 342, and 346. In addition, it must also satisfy its own zone's pressure demand as sensed by pressure sensor 344. While pump 314 is running, master control panel 350 is periodically updated with all of the current operating parameters of all of the slave pump locations, and is continuously calculating the present maximum deviation value in water system 300, as well as which zone is incurring the maximum deviation.

By performing the above calculations, master control panel 350 then decides what the bias signal value should be, which is designated as signal 443 and is transmitted to data highway 370. At slave control panel 354, the bias signal value comes in as signal 543, which will be added to the setpoint 546, if the system transfer device 550 allows this to occur. The bias value 543 will be transmitted through the signal transfer device 550 unless the zone associated with pump 314 and slave control panel 354 is the zone that is currently experiencing the maximum underpressure deviation, and that indication will be provided through the data highway 370 as signal 535. Signal 535, therefore, determines whether or not the signal transfer device 550 is activated and allows the bias signal 543 to added to the setpoint 546.

If the system demand of water control system 300 cannot be satisfied by only the lead pump, then the "Lag1" pump will be activated to help increase the water flowing into water distribution system 320. The pump which is currently designated Lag1 can be any of the other three pumps in water control system 300 (i.e., it cannot be the lead pump). Once the Lag 1 pump has started, its control panel, whether it is the master control panel 350 or one of the slave control panels, will then use the bias signal command 443 that is output by master control panel 350 into data highway 370. Of course, if the Lag1 pump is associated with the zone that is currently experiencing the maximum underpressure deviation within water control system 300, then its signal transfer device 450 (for the master control panel 350) or 550 (for one of these slave control panels, such as panel 354) will not allow the bias signal 443 or 543, respectively, to be added to the local setpoint 446 or 546, respectively.

Subsequent additional pumps can be added if the system demand requires it, and the operation of each of these added Lag pumps (i.e., Lag2 or Lag3) will either utilize the bias signal that is output from master control panel 350 or not, depending upon whether that particular Lag pump is associated with the zone that is presently experiencing the maximum deviation.

It will be understood that water control system 300 can be modified to operate as a booster or high service pump control system having more than one zone of system loads for some or all of the individual pumping sources. Such a system can be utilized in a non-recirculating system that does not have any type of return lines, or can be utilized in a recirculating system that does have a return line and returns all of the water or liquid chemicals back to the original pumping source.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A water system of the type that includes at least one primary pump, at least one heat exchanging device, at least one variable speed secondary pump, a return pipe connected to the suction side of said primary pump, a supply pipe connected to the discharge side of said variable speed secondary pump, at least one system load having a supply and return line, said water system comprising:

(a) a local differential pressure sensor connected to said supply pipe and to said return pipe, said local differential pressure sensor including an output that generates a first signal related to the differential pressure across the local differential pressure sensor;

(b) a remote differential pressure sensor connected to the supply and return lines at each of said at least one system load, said remote differential pressure including an output that generates a second signal related to the differential pressure across the remote differential pressure sensor;

(c) a remote control panel located near each of said at least one system load, said remote control panel having a second processing circuit which includes a memory circuit, input/output circuits, and a clock circuit that measures real time, said second processing circuit being configured to receive the second signal generated by the output of said remote differential pressure sensor, said second processing circuit additionally having a communications output device that transmits information corresponding to said signal; and (d) a local control panel having a first processing circuit which includes a memory circuit, input/output circuits, and a clock circuit that measures real time, said first processing circuit further including a controller that controls the speed of a pump, said first processing circuit being configured to receive the first signal generated by the output of said local differential pressure sensor, said first processing circuit additionally having a communications input device that receives said information transmitted by said communications output device at the remote control panel, said first processing circuit being configured to control the speed of said at least one variable speed secondary pump based upon the values of said first and second signals.

2. The water system as recited in claim 1, wherein said first and second signals are electrical signals.

3. The water system as recited in claim 1, wherein said first and second signals are pneumatic signals.

4. A water system of the type that includes at least one primary pump, at least one heat exchanging device, at least one variable speed secondary pump, a return pipe connected to the suction side of said primary pump, a supply pipe connected to the discharge side of said variable speed secondary pump, at least one system load having a supply and return line, said water system comprising:

(a) a local differential pressure sensor connected to said supply pipe and to said return pipe, said local differential pressure sensor including an output that generates a first signal related to the differential pressure across the local differential pressure sensor, (b) a remote differential pressure sensor connected to the supply and return line at each of said at least one system load, said remote differential pressure including an output that generates a second signal related to the differential pressure across the remote differential pressure sensor;

(c) a remote control panel located near each of said at least one system load, said remote control panel having a second processing circuit which includes a memory circuit, input/output circuits, and a clock circuit that measures real time, said second processing circuit being configured to receive the second signal generated by the output of said remote differential pressure sensor, said second processing circuit additionally having a communications output device that transmits information corresponding to said second signal; and (d) a local control panel having a first processing circuit which includes a memory circuit, input/output circuits, and a clock circuit that measures real time, said first processing circuit further including a controller that controls the speed of a pump, said first processing circuit being configured to receive the first signal generated by the output of said local differential pressure sensor, said first processing circuit additionally having a communications input device that receives said information transmitted by said communications output device at the remote control panel, said first processing circuit being configured to provide a setpoint for each of said at least one system load, wherein the setpoint represents the desired pressure for that system load, said first processing circuit being configured to determine the magnitude of deviation between the actual differential pressure sensed by each said remote differential pressure sensor and said setpoint for each corresponding system load based upon the information received from said communications output device at the remote control panel and its associated setpoint, said deviation creating a third signal, said first processing circuit using said third signal to modify said first signal to create a fourth signal, said first processing circuit being configured to control the speed of said at least one variable speed secondary pump based upon the value of said fourth signal.

5. The water system as recited in claim 4, wherein said first and second signals are electrical signals.

6. The water system as recited in claim 4, wherein said first and second signals are pneumatic signals.

7. A water system of the type that includes at least one primary pump, at least one heat exchanging device, at least one variable speed secondary pump, a return pipe connected to the suction side of said primary pump, a supply pipe connected to the discharge side of said variable speed secondary pump, at least one zone containing a system load having a supply and return line, said water system comprising:

(a) a local differential pressure sensor connected to said supply pipe and to said return pipe, said local differential pressure sensor including an output that generates a first signal related to the differential pressure across the local differential pressure sensor;

(b) a remote differential pressure sensor connected to the supply and return line at each of said at least one zone, said remote differential pressure including and output that generates a second signal related to the differential pressure across the remote differential pressure sensor;

(c) a remote control panel located near each of said at least one zone, said remote control panel having a second processing circuit which includes a memory circuit, input/output circuits, and a clock circuit that measures real time, said second processing circuit being configured to receive the second signal generated by the output of said remote differential pressure sensor, said second processing circuit additionally having a communications output device that transmits information corresponding to said second signal; and (d) a local control panel having a first processing circuit which includes a memory circuit, input/output circuits, and a clock circuit that measures real time, said first processing circuit further including a controller that controls the speed of a pump, said first processing circuit being configured to receive the first signal generated by the output of said local differential pressure sensor, said first processing circuit additionally having a communications input device that receives said information transmitted by said communications output device at the remote control panel, said first processing circuit being configured to provide a setpoint for each of said at least one zone, wherein the setpoint represents the desired pressure for that zone, said first processing circuit being configured to determine the zone requiring the greatest amount of correction to bring the actual differential pressure of a particular zone to its set point, and to create a third signal corresponding to the magnitude of said greatest amount of correction required based upon the information received form said communications output device at the remote control panel and its associated setpoint, said first processing circuit using said third signal to modify said first signal to create a fourth signal, said first processing circuit being configured to control the speed of said at least one variable speed secondary pump based upon the value of said fourth signal.

8. The water system as recited in claim 7, wherein said first and second signals are electrical signals.

9. The water system as recited in claim 7, wherein said first and second signals are pneumatic signals.

10. A water system of the type that includes at least one primary pump, at least one heat exchanging device, at least one variable speed secondary pump, a return pipe connected to the suction side of said primary pump, a supply pipe connected to the discharge side of said variable speed secondary pump, at least one zone containing a system load having a supply and return line, said water system comprising:

(a) a local differential pressure sensor connected to said supply pipe and to said return pipe, said local differential pressure sensor including an output that generates a first signal related to the differential pressure across the local differential pressure sensor.

(b) a remote differential pressure sensor connected to the supply and return line at each of said at least one zone, said remote differential pressure including an output that generates a second signal related to the differential pressure across the remote differential pressure sensor;

(c) a remote control panel located near each of said at least one zone, said remote control panel having a second processing circuit which includes a memory circuit, input/output circuits, and a clock circuit that measures real time, said second processing circuit being configured to receive the second signal generated by the output of said remote differential pressure sensor, said second processing circuit additionally having a communications output device that transmits information corresponding to said second signal; and (d) a local control panel having a first processing circuit which includes a memory circuit, input/output circuits, and a clock circuit that measures real time, said first processing circuit further including a controller that controls the speed of a pump, said first processing circuit being configured to receive the first signal generated by the output of said local differential pressure sensor, said first processing circuit additionally having a communications input device that receives said information transmitted by said communications output device at the remote control panel, said first processing circuit being configured to provide a setpoint for each of said at least one zone, wherein the setpoint represents the desired pressure for that zone, said first processing circuit being configured to determine the zone having the highest load, and to create a third signal corresponding to the magnitude of said highest load based upon the information received from said communications output device at the remote control panel, said first processing circuit using said third signal to modify said first signal to create a fourth signal, said first processing circuit being configured to control the speed of said at least one variable speed secondary pump based upon the value of said fourth signal.

11. The water system as recited in claim 10, wherein said first and second signals are electrical signals.

12. The water system as recited in claim 10, wherein said first and second signals are pneumatic signals.

13. A water system of the type that includes at least one primary pump, at least one heat exchanging device, at least one variable speed secondary pump, a supply pipe connected to the discharge side of said variable speed secondary pump, at least one system load having a supply line, said water system comprising:

(a) a local pressure sensor connected to said supply pipe, said local pressure sensor including an output that generated a first signal related to the pressure at the local pressure sensor;

(b) a remote pressure sensor connected to the supply line at each of said at least one system load, said remote pressure including an output that generates a second signal related to the pressure at the remote pressure sensor;

(c) a remote control panel located near each of said at least one system load, said remote control panel having a second processing circuit which includes a memory circuit, input/output circuits, and a clock circuit that measures real time, said second processing circuit being configured to receive the second signal generated by the output of said remote pressure sensor, said second processing circuit additionally having a communications output device that periodically transmits information corresponding to said second signal; and (d) a local control panel having a first processing circuit which includes a memory circuit, input/output circuits, and a clock circuit that measures real time, said first processing circuit further including a controller that controls the speed of a pump, said first processing circuit being configured to receive in real time the first signal generated by the output of said local pressure sensor, said first processing circuit additionally having a communications input device that periodically receives said information transmitted by said communications output device at the remote control panel, said first processing circuit being configured to control the speed of said at least one variable speed secondary pump based upon the values of said first and second signals.

14. The water system as recited in claim 13, wherein said first processing circuit is further configured to provide a setpoint for each of said at least one system load, wherein the setpoint represents the desired pressure for that system load, said first processing circuit also being configured to determine the magnitude of deviation between the actual pressure sensed by each said remote pressure sensor and said setpoint for each corresponding system load based upon the information received from said communications output device at the remote control panel and its associated setpoint, said deviation creating a third signal, said first processing circuit using said third signal to modify said first signal to create a fourth signal, said first processing circuit being configured to control the speed of said at least one variable speed secondary pump based upon the value of said fourth signal.

15. The water system as recited in claim 13, wherein said at least one system load is contained within at least one zone; said first processing circuit is further configured to provide a setpoint for each of said at least one zone, wherein the setpoint represents the desired pressure for that zone, said first processing circuit being configured to determine the zone requiring the greatest amount of correction to bring the actual pressure of a particular zone to its setpoint, and the create a third signal corresponding to the magnitude of said greatest amount of correction required based upon the information received from said communications output device at the remote control panel and its associated setpoint, said first processing circuit using said third signal to modify said first signal to create a fourth signal, said first processing circuit being configured to control the speed of said at least one variable speed secondary pump based upon the value of said fourth signal.

16. The water system as recited in claim 13, wherein said at least one system load is contained within at least one zone; said first processing circuit is further configured to provide a setpoint for each of said at least one zone, wherein the setpoint represents the desired pressure for that zone, said first processing circuit being configured to determine the zone having the highest load based upon the information received from said communications output device at the remote control panel, said first processing circuit using said third signal to modify said first signal to create a fourth signal, said first processing circuit being configured to control the speed of said at least one variable speed secondary pump based upon the value of said fourth signal.

17. A method for controlling a water system of the type that includes at least one primary pump, at least one heat exchanging device, at least one variable speed secondary pump, a return pipe connected to the suction side of said primary pump, a supply pipe connected to the discharge side of said variable speed secondary pump, at least one system load having a supply and return line, said water system comprising:

(a) measuring the differential pressure across said supply and return pipes and creating a first signal related to this local differential pressure;

(b) measuring the differential pressure across said supply and return lines at each of said at least one system load and creating a second signal related to this remote differential pressure;

(c) communicating said second signal at periodic intervals to a control panel;

(d) communicating said first signal in real time to said control panel; and (e) controlling the speed of said at least one variable speed secondary pump based upon the values of said first and second signals.

18. The method as recited in claim 17, further comprising the steps of providing a setpoint for each of said at least one system load, wherein the setpoint represents the desired differential pressure for that system load; determining the magnitude of deviation between the actual differential pressure measured at each said one system load and its corresponding setpoint based upon said second signal and its associated setpoint, said deviation creating a third signal; modifying said first signal based upon the value of said third signal to create a fourth signal; and controlling the speed of said at least one variable speed secondary pump based upon the value of said fourth signal.

19. The method as recited in claim 17, further comprising the steps of grouping said at least one system load into at least one zone; providing a setpoint for each of said at least one system zone, wherein the setpoint represents the desired differential pressure for that zone; determining the zone requiring the greatest amount of correction to bring the actual pressure of a particular zone to its setpoint, said determination creating a third signal corresponding to the magnitude of said greatest amount of correction required based upon information, including said second signal, received by said control panel; using said third signal to modify said first signal to create a fourth signal; and controlling the speed of said at least one variable speed secondary pump based upon the value of said fourth signal.

20. The method as recited in claim 17, further comprising the steps of grouping said at least one system load into at least one zone; providing a setpoint for each of said at least one system zone, wherein the setpoint represents the desired differential pressure for that zone; determining the zone having the highest load, and creating a third signal corresponding to the magnitude of said highest load based upon information, including said second signal, received by said control panel; using said third signal to modify said first signal to create a fourth signal; and controlling the speed of said at least one variable speed secondary pump based upon the value of said fourth signal.

21. A method for controlling a water system of the type that includes at least one primary pump, at least one heat exchanging device, at least one variable speed secondary pump, a supply pipe connected to the discharge side of said variable speed secondary pump, at least one system load having a supply line, said water system comprising:

(a) measuring the pressure at said supply pipe and creating a first signal related to this local pressure;

(b) measuring the pressure at said supply line at each of said at least one system load and creating a second signal related to this remote pressure;

(c) communicating said second signal at periodic intervals to a control panel;

(d) communicating said first signal in real time to said control panel; and (e) controlling the speed of said at least one variable speed secondary pump based upon the values of said first and second signals.

22. The method as recited in claim 21, further comprising the steps of providing a setpoint for each of said at least one system load, wherein the setpoint represents the desired pressure for that system load; determining the magnitude of deviation between the actual pressure measured at each said one system load and its corresponding setpoint based upon said second signal and its associated setpoint, said deviation creating a third signal; modifying said first signal based upon the value of said third signal to create a fourth signal; and controlling the speed of said at least one variable speed secondary pump based upon the value of said fourth signal.

23. The method as recited in claim 21, further comprising the steps of grouping said at least one system load into at least one zone; providing a setpoint for each of said at least one system zone, wherein the setpoint represents the desired pressure for that zone; determining the zone requiring the greatest amount of correction to bring the actual pressure of a particular zone to its setpoint, said determination creating a third signal corresponding to the magnitude of said greatest amount of correction required based upon information, including said second signal, received by said control panel; using said third signal to modify said first signal to create a fourth signal; and controlling the speed of said at least one variable speed secondary pump based upon the value of said fourth signal.

24. The method as recited in claim 21, further comprising the steps of grouping said at least one system load into at least one zone; providing a setpoint for each of said at least one system zone, wherein the setpoint represents the desired pressure for that zone; determining the zone having the highest load, and creating a third signal corresponding to the magnitude of said highest load based upon information, including said second signal, received by said control panel; using said third signal to modify said first signal to create a fourth signal; and controlling the speed of said at least one variable speed secondary pump based upon the value of said fourth signal.

25. A water system of the type that includes a plurality of zones each containing a water source, at least one variable speed pump per said water source, at least one system load, a pipe from each of said plurality of water sources to said at least one system load, said water system comprising:

(a) a first pressure sensor connected to one of said pipes, said first pressure sensor having an output that generates a first signal related to the pressure at said first pressure sensor;

(b) a master control panel associated with a first one of said zones, said master control panel having a first processing circuit which includes a memory circuit, input/output circuits, and a clock circuit that measures real time, said processing circuit further including a controller that controls the speed of a pump, said first processing circuit being configured to receive said first signal, said first processing circuit having a communications input/output device that transmits and receives information related to said water system, said first processing circuit being configured to provide a setpoint for said first zone;

(c) a second pressure sensor connected to another of said pipes, said second pressure sensor having an output that generates a second signal related to the pressure at said second pressure sensor;

(d) at least one slave control panel, the first one of said slave control panels being associated with a second one of said zones, said first slave control panel having a second processing circuit which includes a memory circuit, input/output circuits, and a clock circuit that measures real time, said second processing circuit further including a controller that controls the speed of a pump, said second processing circuit being configured to receive said second signal, said second processing circuit having a communications input/output device that transmits and receives information related to said water system, said second processing circuit being configured to provide a setpoint for said second zone;

(e) a data highway that communicates information to and from each of said master and slave control panels;

(f) said first processing circuit additionally being configured to determine each of the setpoints and actual pressures for all zones within said water system, then to determine a bias value needed by said water system so that said at least one variable speed pump that is presently operating is controlled in a manner to satisfy the setpoints at all of said zones, said first processing circuit being configured to transmit said bias value to said at least one slave control panel via the data highway, said first processing circuit using said bias value to modify the setpoint for said first zone accordingly to control said at least one variable speed pump associated with said first zone; and (g) each of said at least one slave control panel's second processing circuit additionally being configured to receive said bias value from the data highway, said second processing circuit using said bias value to modify the setpoint for said second zone accordingly to control said at least one variable speed pump associated with said second zone.

26. The water system as recited in claim 25, wherein said first processing circuit is further configured to determine the deviation between the actual pressure and the setpoint for each said zone, said deviation occurring in all zones being used to determine said bias value.

27. The water system as recited in claim 25, wherein said first processing circuit is further configured to determine the zone requiring the greatest amount of correction to bring the actual pressure of a particular zone to its setpoint, and to create a third signal corresponding to the magnitude of said greatest amount of correction required within said water system, said first processing circuit using said third signal to determine said bias value.

28. The water system as recited in claim 25, wherein said first processing circuit is further configured to determine the zone having the highest load, and to create a third signal corresponding to the magnitude of said highest load within said water system, said first processing circuit using said third signal to determine said bias value.

29. The water system as recited in claim 26, wherein the corresponding processing circuit of the one of said master and slave control panels that is associated with the zone that presently is incurring the greatest underpressure deviation ignores said bias value.

30. The water system as recited in claim 27, wherein the corresponding processing circuit of the one of said master and slave control panels that is associated with the zone that presently is requiring the greatest amount of correction to bring its actual pressure to its setpoint ignores said bias value.

31. The water system as recited in claim 28, wherein the corresponding processing circuit of the one of said master and slave control panels that is associated with the zone that presently is incurring the highest load ignores said bias value.

32. A method for controlling a water system of the type that includes a plurality of zones each containing a water source, at least one variable speed pump per said water source, at least one system load, a pipe from each of said plurality of water sources to said at least one system load, said method comprising the steps of:

(a) measuring the pressure at one of said pipes associated with a first one of said zones and providing a first setpoint for said first zone;

(b) measuring the pressure at another of said pipes associated with a second of said zones and providing a second setpoint for said second zone; and (c) determining each of the setpoints and actual pressures for all zones within said water system, then determining a bias value needed by said water system so that said at least one variable speed pump that is presently operating is controlled in a manner to satisfy the setpoints at all of said zones, and modifying the setpoint for each of said zones accordingly, utilizing said bias value.

33. The method as recited in claim 32, further comprising the steps of creating a first signal related to the pressure at said first zone, creating a second signal related to the pressure at said second zone, and communicating at least one of said signals and said setpoint values between zones at periodic intervals, while controlling said at least one variable speed pump in real time.

34. The method as recited in claim 32, further comprising the steps of determining the deviation between the actual pressure and the setpoint for each said zone, and using said deviation occurring in all zones to determine said bias value.

35. The method as recited in claim 34, further comprising the step of ignoring said bias value at the zone that presently is incurring the greatest underpressure deviation.

36. The method as recited in claim 32, further comprising the steps of determining the zone requiring the greatest amount of correction to bring the actual pressure of a particular zone to its setpoint, and using the magnitude of said greatest amount of correction required within said water system to determine said bias value.

37. The method as recited in claim 36, further comprising the step of ignoring said bias value at the zone that presently is requiring the greatest amount of correction to bring its actual pressure to its setpoint.

38. The method as recited in claim 32, further comprising the steps of determining the zone having the highest load, and using the magnitude of said highest load within said water system to determine said bias value.

39. The method as recited in claim 38, further comprising the step of ignoring said bias value at the zone that presently is incurring the highest load.

40. A fluid pumping system of the type having a pumping station that includes at least one variable speed pump, a discharge pipe connected to said pumping station, a system load having a supply line, said discharge pipe being connected to said supply line, said fluid pumping system comprising:

(a) a first pressure sensor connected to said discharge pipe, said first pressure sensor including an output that generates a first signal related to the pressure across the first pressure sensor;

(b) a second pressure sensor connected to the supply line at said system load, said second pressure sensor including an output that generates a second signal related to the pressure across the second pressure sensor;

(c) a second control panel located near said system load, said second control panel having a second processing circuit which includes a memory circuit, input/output circuits, and a clock circuit that measures real time, said second processing circuit being configured to receive the second signal generated by the output of said second pressure sensor, said second processing circuit additionally having a communications output device that transmits information corresponding to said second signal; and (d) a first control panel having a first processing circuit which includes a memory circuit, input/output circuits, and a clock circuit that measures real time, said first processing circuit further including a controller that controls the speed of a pump, said first processing circuit being configured to receive the first signal generated by the output of said first pressure sensor, said first processing circuit additionally having a communications input device that receives said information transmitted by said communications output device at the second control panel, said first processing circuit being configured to control the speed of said at least one variable speed secondary pump based upon the values of said first and second signals, said first processing circuit using a predetermined setpoint at which the desired pressure of the system load is to be maintained, said first signal being used as a bias for said setpoint.

* * * * *

UNITED STATES PATENT AND TRADEMARK OFFICE

CERTIFICATE OF CORRECTION

PATENT NO. : 5,540,555
DATED : July 30, 1996
INVENTOR(S) : Anthony B. Corso and G. Mark Elliott It is certified that error appears in the above-indentified patent and that said Letters Patent is hereby corrected as shown below:

Column 17, line 10 (claim 1), after "said" please insert --second--.

Column 18, line 37 (claim 7), "and" should read --an--.

Column 18, line 67 (claim 7), "set point" should read --setpoint--.

Column 19, line 3 (claim 7), "form" should read --from--.

Column 20, line 11 (claim 7), "generated" should read --generates--.

Column 20, line 65 (claim 15), "the" should read --to--.

Column 21, line 14 (claim 16), after "load" please insert --, and to create a third signal corresponding to the magnitude of said highest load--.

Signed and Sealed this
Third Day of December, 1996

*Attest:*

*Attesting Officer*

Bruce Lehman

BRUCE LEHMAN

*Commissioner of Patents and Trademarks*